US011486109B2

(12) United States Patent
Liu

(10) Patent No.: US 11,486,109 B2
(45) Date of Patent: Nov. 1, 2022

(54) FLOOD-PROTECTIVE VENTILATION LOUVER

(71) Applicant: Hui-Hung Liu, Kaohsiung (TW)

(72) Inventor: Hui-Hung Liu, Kaohsiung (TW)

( * ) Notice: Subject to any disclaimer, the term of this patent is extended or adjusted under 35 U.S.C. 154(b) by 98 days.

(21) Appl. No.: 17/213,243

(22) Filed: Mar. 26, 2021

(65) Prior Publication Data

US 2022/0307214 A1 Sep. 29, 2022

(51) Int. Cl.

| | |
|---|---|
| ***E04H 9/16*** | (2006.01) |
| ***E02B 7/20*** | (2006.01) |
| ***E06B 9/04*** | (2006.01) |
| *E06B 9/00* | (2006.01) |

(52) U.S. Cl.

CPC ..... *E02B 7/205* (2013.01); *E06B 9/04* (2013.01); *E06B 2009/007* (2013.01)

(58) Field of Classification Search

CPC ..... E06B 2009/007; E06B 9/02; E06B 9/04; E06B 7/08; E06B 7/086; E06B 7/098; E04H 9/14; E04H 9/145

See application file for complete search history.

(56) References Cited

U.S. PATENT DOCUMENTS 2,754,747 A * 7/1956 Bertling ..... F24F 13/075 454/309
6,287,050 B1 * 9/2001 Montgomery ..... F24F 11/76 52/573.1
7,353,636 B1 * 4/2008 Anderson ..... E06B 7/086 49/82.1
7,926,539 B1 * 4/2011 Hurst ..... E06B 9/04 49/21
9,551,153 B2 * 1/2017 Anderson, Jr. ..... E04D 13/0431
2002/0021941 A1 * 2/2002 Montgomery ..... F24F 11/76 405/92
2003/0082008 A1 * 5/2003 Sprengle, Sr. ..... E02B 7/40 405/87
2006/0042164 A1 * 3/2006 Downey ..... E06B 7/086 49/74.1
2008/0236062 A1 * 10/2008 Bergaglio ..... F24F 13/084 52/169.5
2013/0279986 A1 * 10/2013 Payne ..... E04B 1/7076 405/98
2015/0251027 A1 * 9/2015 Ro ..... E06B 7/086 160/7
2019/0032397 A1 * 1/2019 Sosa ..... E06B 3/08

* cited by examiner

*Primary Examiner* — Benjamin F Fiorello

(74) *Attorney, Agent, or Firm* — Leong C. Lei

(57) ABSTRACT

A flood-protective ventilation louver includes a window frame assembly, slat assemblies, a transmission mechanism, and a buoyance switch assembly. During flooding, external water passes through the window frame assembly into the buoyance switch assembly, such that the buoyance switch assembly is caused to release the transmission mechanism from constraint to thereby allow the slat of each of the slat assemblies to oscillate downward automatically and thus automatic closing is realized.

34 Claims, 17 Drawing Sheets

FLOOD-PROTECTIVE VENTILATION LOUVER

TECHNICAL FIELD OF THE INVENTION

The present invention relates to a flood-protective ventilation louver, and more particularly to a flood-protective ventilation louver that automatically shuts up during flooding and exhibits an excellent effect of flood protection.

DESCRIPTION OF THE PRIOR ART

The recent trend of extreme deterioration of weather causes occurrences of abnormal weather events, such as droughts and heavy rains, from time to time. This significantly affects the living of people and even cause change to the living habits of a lot of people.

Metropolitan residents may not be susceptible to droughts, but storms and heavy downpours may cause immediate and great influences to them. The urban drainage systems may be immediately responsive to storms and heavy downpours, and flooding may thus occur. Consequently, buildings in a low-lying area are often installed with water-blocking gates and such water-blocking gates are used to provide protection for handling potential flooding caused by storms and heavy downpours. A lot of water-blocking gates that are available in the market are effective in protection against flooding and are increasingly popular.

However, the known water-blocking gates are generally designed for doors and driveway gates of buildings and are not applicable to ventilation louvers that are provided for ventilation purposes for basements and underground parking lots. To reduce the cost of construction, most of the ventilation louvers are installed on a ground level outside a building, and as such, although the installation of water-blocking gates does block outside flooding from invading the building through the main gates or the driveway gates, in case that heavy raindrops cause water accumulation to exceed the height of a ventilation louver, such water may flow through the ventilation louver into the basement and underground parking spaces to make indoor flooding in the basement, which may cause casualty of lives and properties and may make vehicles parked in the underground parking spaces drowned.

Up to date, ventilation louvers that are designed and constructed for ventilation of basements and underground parking lots are generally not provided with any measure for handling flooding. One commonly adopted solution is to manually shut up and close the louver as a responsive operation to heavy downpours. Heavy downpours may not necessarily cause flooding intrusion and in such a case, shutting up the louver would sacrifice the designed function of the louver for ventilation. In case that flooding intrusion may potentially occur, manual operation of shutting up and closing the louver may be sometimes too later or may be simply neglected, eventually causing actual occurrence of flooding intrusion and undesired potential risk to lives and properties. Thus, the commonly adopted way of manual operation to shut up and close a ventilation louver is apparently not a secured way and such an operation involve many hidden uncertain factors that may eventually lead to dangers.

SUMMARY OF THE INVENTION

The present invention provides a food-protective ventilation louver, which helps overcome the concern that the known ventilation louvers constructed in and used with basements and underground parking lots do not include a flood protection solution and do not automatically close and do not exhibit an excellent effect of water blocking.

For such a purpose, the present invention aims to provide a flood-protective ventilation louver. The flood-protective ventilation louver according to the present invention comprises a window frame assembly, slat assemblies, a transmission mechanism, and a buoyance switch assembly.

The window frame assembly comprises a bottom frame member, two side frame members that are corresponding to and opposite to each other, a top frame member that is corresponding to and opposite to the bottom frame member, and a plurality of positioning frame members.

The slat assemblies are provided as multiple ones that are combined with the window frame assembly. Each of the slat assemblies includes a slat in the form of an elongate plate. The slat has an upper end that is extended to form a neck in a manner of slightly inclining and tapering to gradually reduce the thickness thereof. The neck is further connected to a pivot axle. The pivot axle has an outer circumference of which a cross section is formed in a configuration of an elongate circular hole. The slat has one side into which a constraint bar is penetrating and mounted to. Each of the slats has two sides each including a closure piece. Each of the closure pieces is provided, at an outer side thereof, with a positioning piece. The positioning piece includes an axle, and the axle extends through a hollow mounting ring of the closure piece to extend into the pivot axle.

The transmission mechanism comprises a connecting piece and a moving piece and is mounted to the window frame assembly to drive the slats of the slat assemblies to move. The connecting piece is formed as an elongate plate and includes a flat plate portion and a pair of wing portions. The moving piece is formed as an elongate body and includes a sliding channel into which the wing portions of the connecting piece are received to penetrate therethrough. The moving piece further includes a plurality of slot openings that are arranged at intervals.

The buoyance switch assembly comprises a bottom box, a float, a trigger seat, and a surface cover. The buoyance switch assembly is disposed in the receptacle portion of the bottom frame member to drive the transmission mechanism to move.

The efficacy that the present invention may achieve with the above-described structure is that during flooding, external water passes through the bottom frame member to get into the buoyance switch assembly, so as to cause the float of the buoyance switch assembly to move upward, releasing the link bar of the buoyance switch assembly from retaining engagement with the arresting piece, and consequently, the arresting piece is no longer retained by the link bar, and thus, the moving piece of the transmission mechanism is not constrained by the arresting piece to allow the moving piece to drive the slats of the slat assemblies to move. As such, due to the moving piece being no longer constrained, the slat of each of the slat assemblies oscillates downward to achieve an effect of automatic closing, by which the efficacy of flooding protection is realized.

DETAILED DESCRIPTION OF THE PREFERRED EMBODIMENT

A flood-protective ventilation louver according to the present invention at least comprises a window frame assembly 1, slat assemblies 2, a transmission mechanism 3, and a buoyance switch assembly 4.

Figure 1:
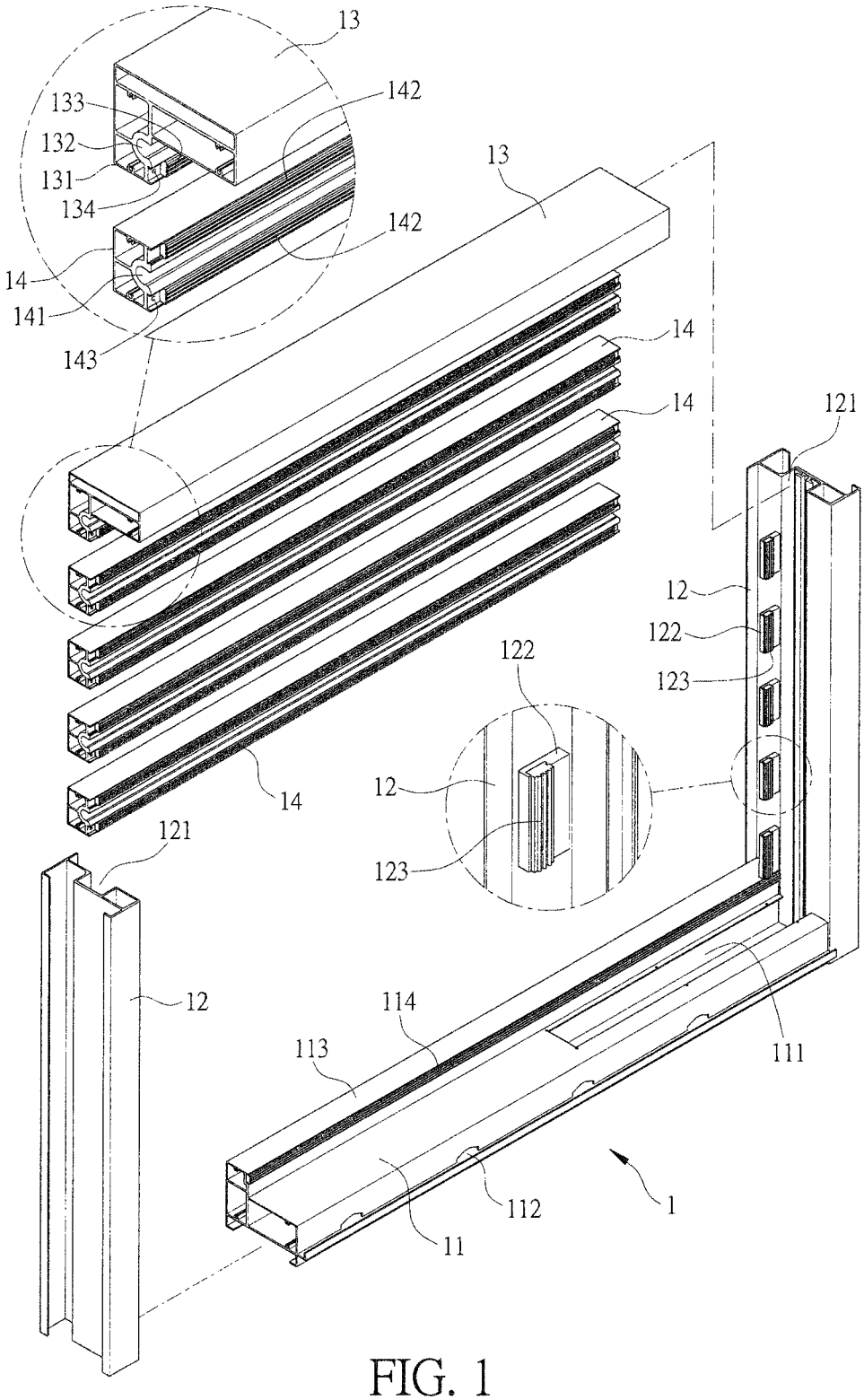
FIG. 1 is an exploded view showing a window frame according to the present invention.

Firstly, reference being had to FIG. 1, the window frame assembly 1 is made of a hollow material and includes a bottom frame member 11, two side frame members 12 that are corresponding to and opposite to each other, a top frame member 13 that is corresponding to and opposite to the bottom frame member 11, and a plurality of positioning frame members 14.

The bottom frame member 11 comprises a hollowed elongate body, of which the body defines a receptacle portion 111 that is opened to face upward. A plurality of through holes 112 are formed in a side wall of the bottom frame member 11, and a raised portion 113 is provided on an opposite side of the bottom frame member 11. The raised portion 113 has a side wall on which a water-resisting strip 114 is arranged alongside.

The two side frame members 12 are respectively mounted and fixed to two opposite ends of the bottom frame member 11. The two side frame members 12 each include a recessed channel 121 extending in a vertical direction and a plurality of seats 122 mounted to and arranged along one of the side portions thereof that are outside of the recessed channel 121. The seats 122 are provided with water-resisting strips 123 mounted thereto.

The top frame member 13 comprises a hollowed elongate body, of which two ends are respectively corresponding to and fixed to the two side frame members 12. The top frame member 13 includes a bottom protrusion portion 131 mounted to one side thereof to correspond to the raised portion 113 of the bottom frame member 11. The bottom protrusion portion 131 includes a curved channel 132 extending along an axial direction thereof and in a partly opening form. Preferably, the curved channel 132 has a cross section that comprises a horizontal elliptic configuration having an opening of which upper and lower edges each form a projection that is slightly raised and extending towards an interior of the channel. The lower edge of the curved channel 132 is provided with a water-resisting strip 133 mounted thereto and screw holes 134 formed at two ends of the water-resisting strip 133.

The plurality of positioning frame members 14 are arranged such that each of the positioning frame members 14 comprises an elongate body located between the bottom frame member 11 and the top frame member 13. Each of the positioning frame members 14 has two ends that are mounted to and fixed to the two side frame members 12 by fastening elements. Each of the positioning frame members 14 is provided, in one side thereof, with a curved groove 141 extending along an axial direction thereof and in a partly opening form. Preferably, the curved groove 141 has a cross section that comprises a horizontal elliptic configuration and a water-resisting strip 142 is provided at location adjacent to each of upper and lower edges of the curved groove 141. The lower edge is provided with screw holes 143 at two ends thereof and adjacent to the water-resisting strip 142.

Figure 2:
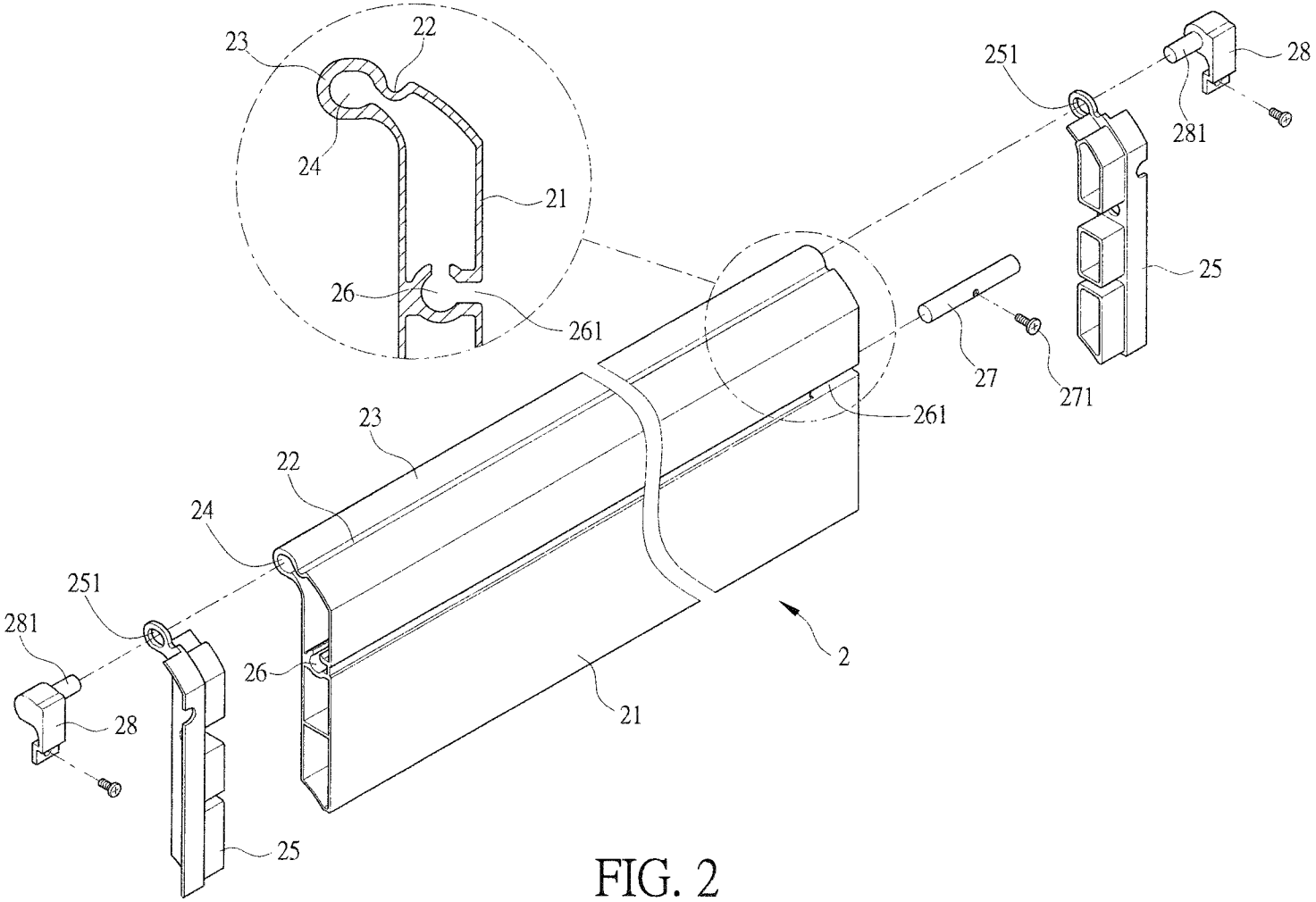
FIG. 2 is an exploded view showing a slat assembly according to the present invention.

Referring to FIG. 2, a plurality of slat assemblies 2 are provided such that each of the slat assemblies 2 includes a slat 21 in the form of an elongate plate. The slat 21 has an upper end which is extended to form a neck 22 in a manner of slightly inclining and tapering to gradually reduce the thickness thereof. The neck 22 is further connected to a pivot axle 23. The pivot axle 23 has an outer circumference of which a cross section is formed in a configuration of an elongate circular hole. Further, the pivot axle 23 defines therein an elongate circular hole 24. Each of the slats 21 has two sides each including a closure piece 25. The closure piece 25 includes a hollow mounting ring 251. The closure piece 25 is provided for forming closure for sealing the slat 21, the neck 22, and the pivot axle 23. In an embodiment, the closure piece 25 is formed in a shape or configuration that corresponds to and matches, in shape, with the slat 21, the neck 22, the pivot axle 23, and the elongate circular hole 24. The slat 21 has a surface that is formed with a horizontal groove 26. The horizontal groove 26 is provided, at one side thereof, with an elongate slot opening 261. The horizontal groove 26 has an interior into which a constraint bar 27 is inserted. The constraint bar 27 is provided with a fixing element 271 for the purpose of fixing. The fixing element 271 extends through the elongate slot opening 261 and is mounted to the constraint bar 27. Each of the closure pieces 25 is provided, at an outer side thereof, with a positioning piece 28. The positioning piece 28 includes an axle 281, and the axle 281 extends through the hollow mounting ring 251 of the closure piece 25 to reach into the elongate circular hole 24 of the pivot axle 23.

Figure 3:
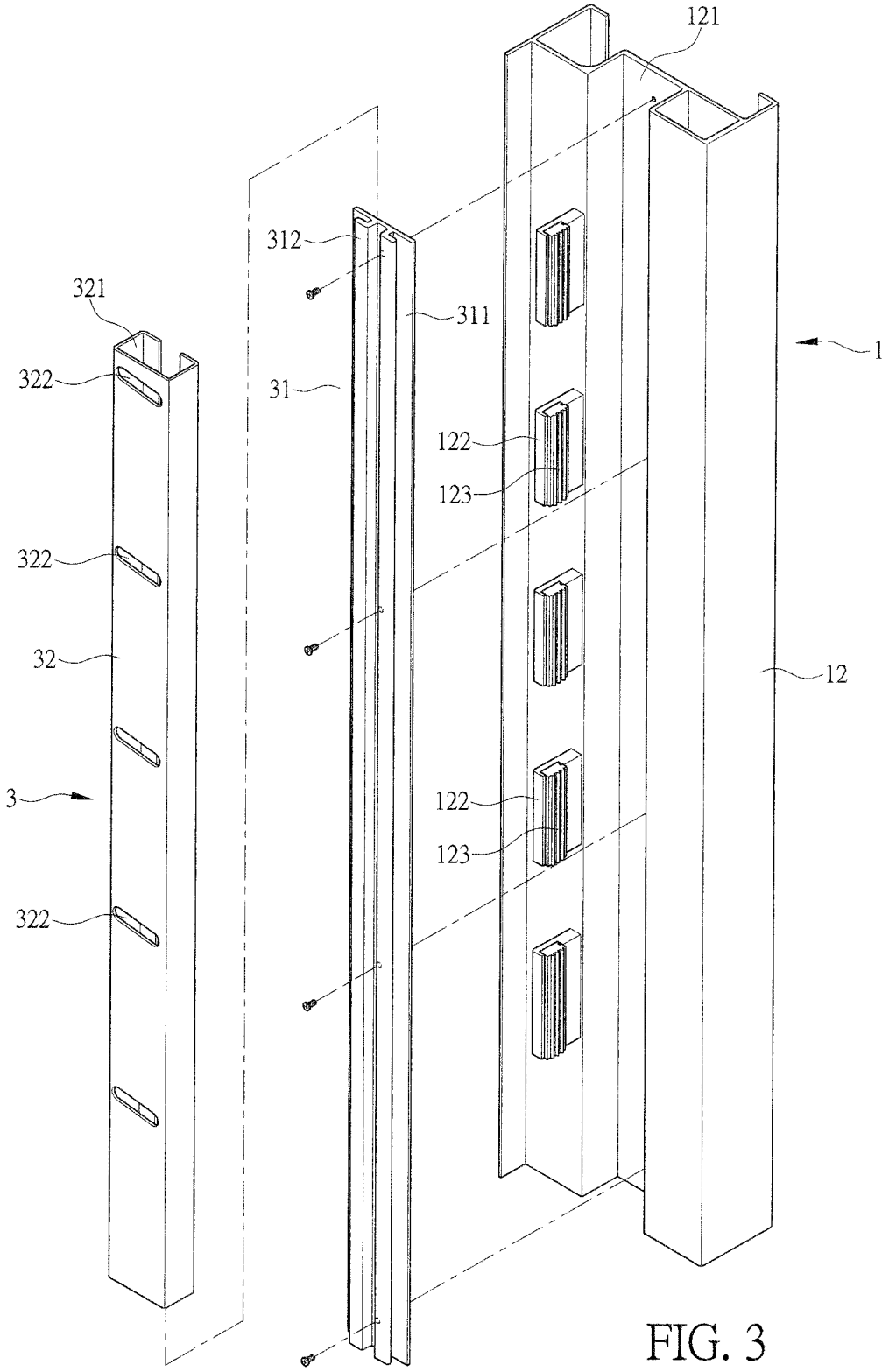
FIG. 3 is an exploded view showing a transmission mechanism according to the present invention.

Referring to FIG. 3, the transmission mechanism 3 comprises a connecting piece 31 and a moving piece 32. The connecting piece 31 is formed as an elongate plate and includes a flat plate portion 311 and a pair of wing portions 312. The moving piece 32 is formed as an elongate body and includes a sliding channel 321 into which the wing portions 312 of the connecting piece 31 are received to penetrate therethrough. The moving piece 32 further includes a plurality of slot openings 322 that are arranged at intervals. The slot openings 322 are preferably formed as elongate slots or elongate openings that incline relative to the horizontal direction.

Figure 4:
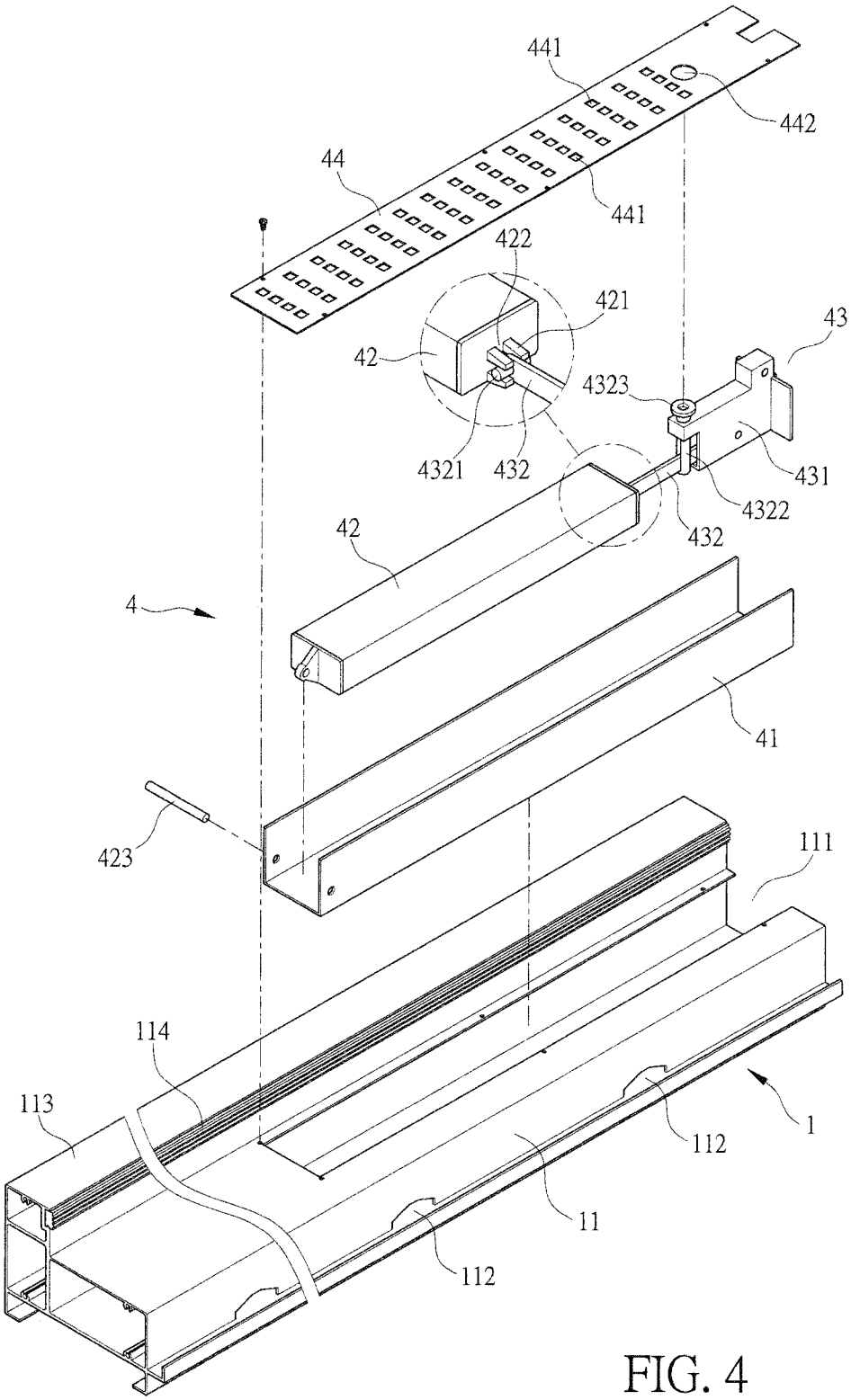
FIG. 4 is an exploded view showing a buoyance switch assembly according to the present invention.
Figure 5:
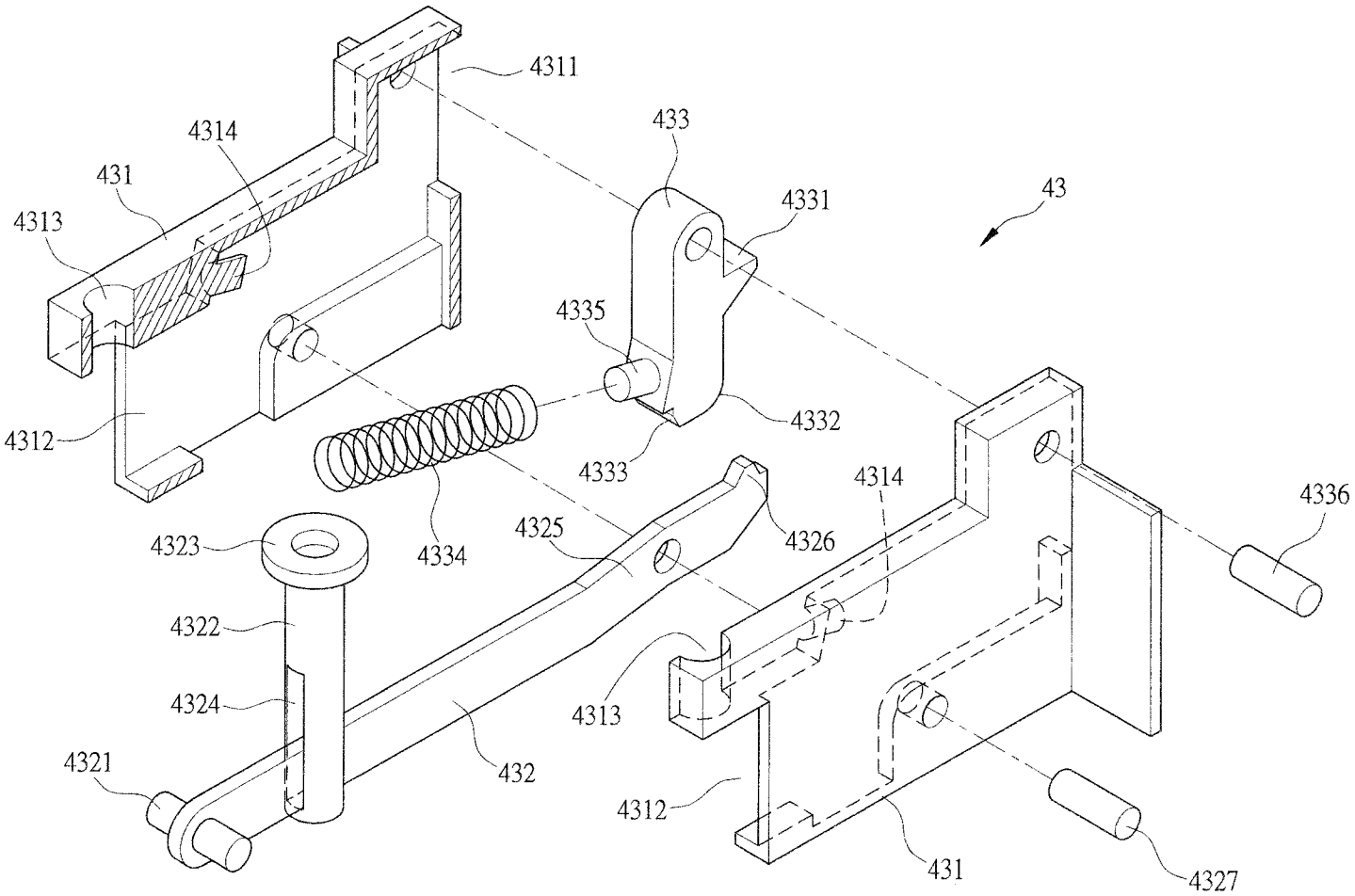
FIG. 5 is an exploded view showing a trigger seat according to the present invention.

Referring to FIGS. 4 and 5, the buoyance switch assembly 4 includes a bottom box 41, a float 42, a trigger seat 43, and a surface cover 44.

The bottom box 41 is made open in a top and two ends thereof and corresponds, in size, to the receptacle portion 111 of the bottom frame member 11, so that the bottom box 41 is disposed in the receptacle portion 111 of the bottom frame member 11.

The float 42 has an end pivotally connected through a pin 423 to the bottom box 41. An opposite end of the float 42 is provided with a mounting base 421. The mounting base 421 includes a cruciform groove 422.

The trigger seat 43 includes a shell base 431, a link bar 432, and an arresting piece 433.

The shell base 431 has two sides respectively including a first hollowed area 4311 and a second hollowed area 4312 that are open to the outside and also includes a through hole 4313 formed beside the second hollowed area 4312 and penetrating therethrough in a vertical direction.

The link bar 432 has an end to which a cross bar 4321 is mounted. A peg 4322 is fit over the link bar 432. The peg 4322 has an upper end that includes a head part 4323 larger, in diameter, than a bar portion thereof. The peg 4322 is formed with an elongate penetration slot 4324 through which the link bar 432 extends. In an embodiment, the peg 4322 is first inserted through the through hole 4313 of the shell base 431, and then the elongate penetration slot 4324 receives the link bar 432 to extend therethrough, and then, the cross bar 4321 is mounted to the link bar 432 for assembling and fixing. An opposite end of the link bar 432 is curved upward, slightly, in a warped form, to form a curved-up segment 4325. The curved-up segment 4325 is formed, on an upper side thereof at a location adjacent to an end thereof, with a projecting block 4326. Preferably, the projecting block 4326 is formed with a slope edge for at least one of outside surfaces thereof that is made inclining. The curved-up segment 4325 receives a pin 4327 to penetrate therethrough for connecting the link bar 432 and the shell base 431 to each other.

The arresting piece 433 is formed as an elongate block that has an upper portion that is mounted inside the shell base 431 by a pin 4336 penetrating through two opposite lateral side surfaces thereof The arresting piece 433 is provided, on one of end sides thereof, with a stage 4331 projecting therefrom. The arresting piece 433 has a lower side of which one corner is formed as arc rounded corner 4332 as a circular arc and an opposite corner is formed as a sloped corner 4333 having an outside surface that is made inclined. A spring 4334 is arranged on an end side of the arresting piece 433.

The trigger seat 43, as being formed through proper assembling of the components, is such that the link bar 432 extends out through the second hollowed area 4312 of the trigger seat 43, and the cross bar 4321 at an end of the link bar 432 is fit into the cruciform groove 422 of the mounting base 421 of the float 42, making the cross bar 4321 and the float 42 fit to and coupled with each other and also allowing the cross bar 4321 to rotate in the cruciform groove 422 of the mounting base 421 to thereby connect the float 42 and the link bar 432 to each other through pivotal connection, and also allowing the link bar 432 to move through rotation of the cross bar 4321 in the cruciform groove 422 of the mounting base 421 to thereby enabling the link bar 432 to oscillate up and down and also allowing the peg 4322 that is fit outside the link bar 432 to be located in the through hole 4313 of the shell base 431. Further, the stage 4331 of the arresting piece 433 is also slightly projecting out of the first hollowed area 4311 of the shell base 431, and the spring 4334 is supported between the arresting piece 433 and the shell base 431, such that the arresting piece 433 is biased and pushed by the spring force of the spring 4334. Preferably, the arresting piece 433 is provided with a joining piece 4335 for fixing and supporting the spring 4334, and the shell base 431 is also provided with a joining piece 4314 for fixing and supporting the spring 4334, in order to improve security and stability of the spring 4334. Further, upon being properly assembled, the sloped corner 4333 of the arresting piece 433 is in abutting engagement with the slope edge of the outside surface of the projecting block 4326 of the link bar 432.

The surface cover 44 is in the form of a thin plate and includes a plurality of hollowed portions 441 and at least one extending-through hole 442 extending through a body thereof and is positionable on and covering the receptacle portion 111 of the bottom frame member 11 and can be mounted to the bottom frame member 11.

Finally, the float 42 and the trigger seat 43 so assembled are disposed in the bottom box 41, and the surface cover 44 is set to cover the top side of the bottom box 41. Under such a condition, the extending-through hole 442 of the surface cover 44 is at a location exactly corresponding to the peg 4322 of the link bar 432, allowing the head part 4323 of the peg 4322 to project outside the extending-through hole 442 of the surface cover 44. This completes assembling of the buoyance switch assembly 4.

Figure 6:
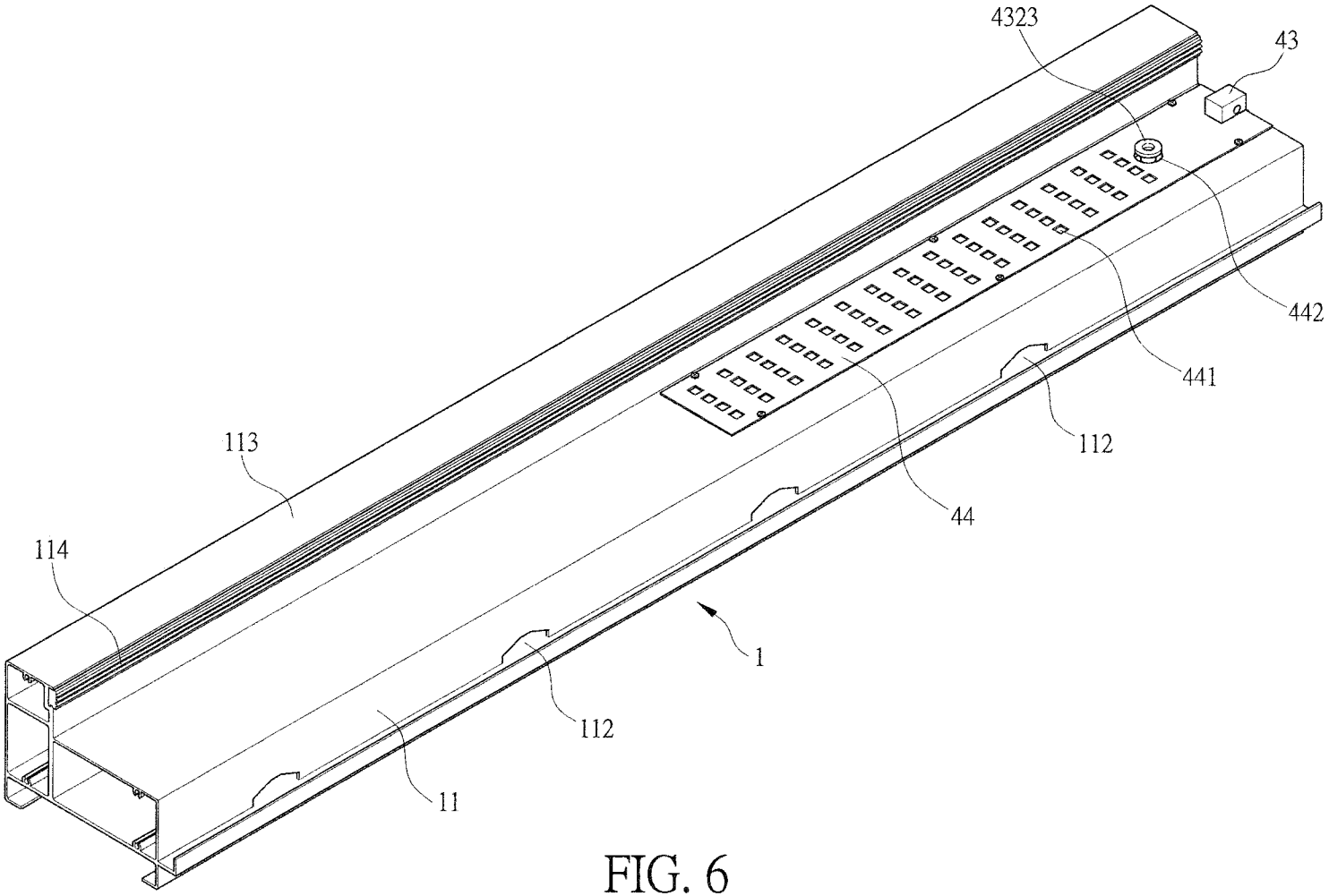
FIG. 6 is a schematic view showing the buoyance switch assembly and a bottom frame member according to the present invention in an assembled form.

Further referring to FIGS. 4 and 6, to assemble the buoyance switch assembly 4 to the window frame assembly 1 according to the present invention, the buoyance switch assembly 4 is first disposed into the receptacle portion 111 of the bottom frame member 11, and the surface cover 44 of the buoyance switch assembly 4 is fastened and thus fixed to the bottom frame member 11.

Figure 7:
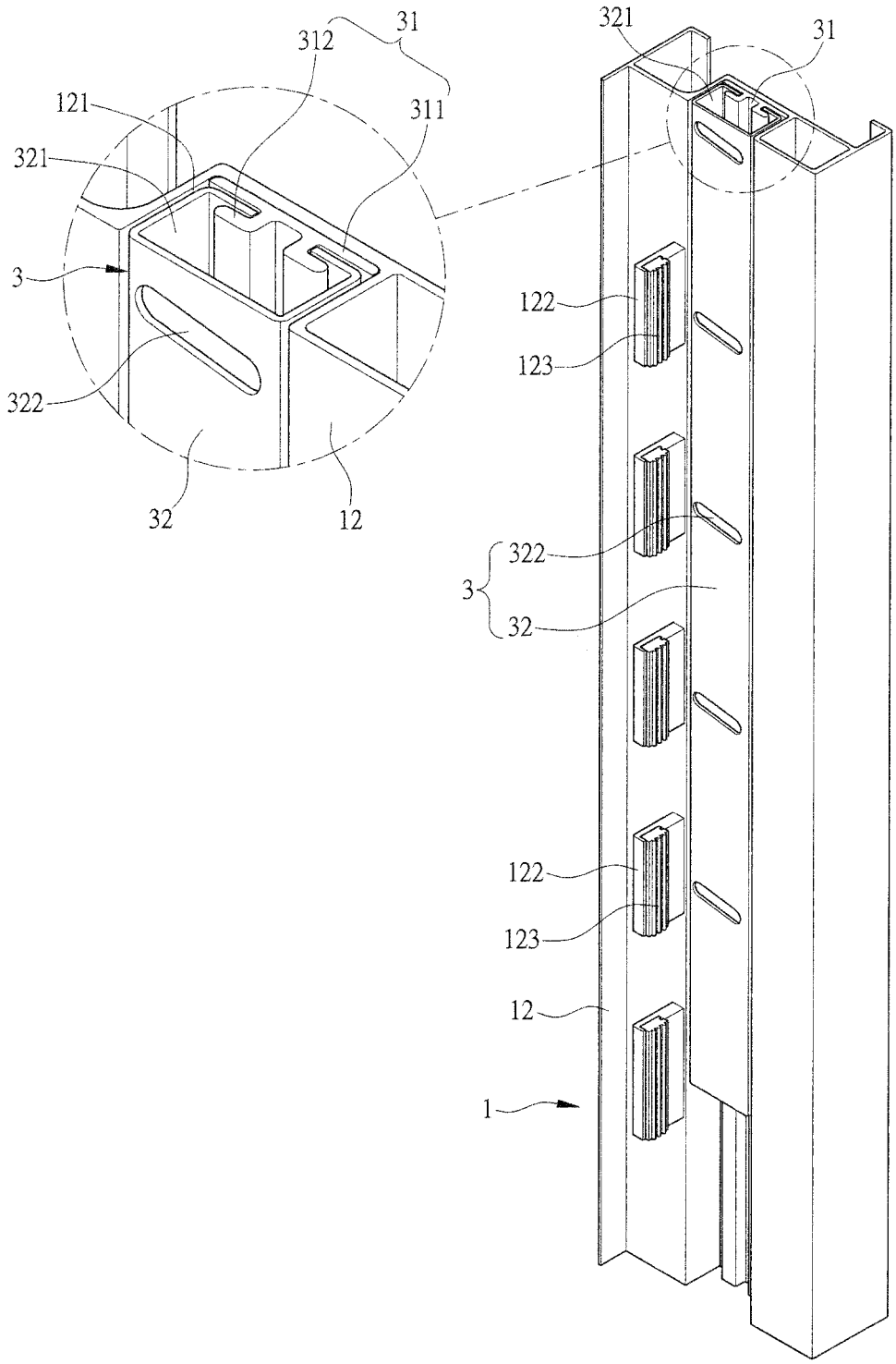
FIG. 7 is a schematic view showing the transmission mechanism and a side frame member according to the present invention in an assembled form.

Assembling of the transmission mechanism 3 to the window frame assembly 1 is then performed. With further referring to FIGS. 1, 3, and 7, the connecting piece 31 of the transmission mechanism 3 is fit into the two upright side frame members 12 that are opposite to each other, and as such, the connecting piece 31 is fit into and embedded in the recessed channel 121 of the one of the upright side frame members 12, and is fixed in the recessed channel 121 of the one of the upright side frame members 12 by fastening elements, such as screws. Subsequently, the moving piece 32 is fit, by means of the sliding channel 321 thereof, over the wing portions 312 of the connecting piece 31 to complete the assembling of the connecting piece 31 and the moving piece 32. Then, the two upright the side frame members 12 are each combined with the bottom frame member 11, and then, the top frame member 13 is fixed to the two upright side frame members 12 at a topmost position thereof. The combining is achieved with screws in combination with and screwing into mounting holes that are formed in advance in each frame of the window frame assembly 1. However, fastening or combining with screws is a known technique and is not a novel part of the present, so that no further description will be provided herein. Upon completing the assembling and combination of the bottom frame member 11, the upright side frame members 12, and the top frame member 13, each of the positioning frame members 14 is assembled, in sequence and at intervals, to the two upright side frame members 12. Similarly, the assembling and combining is achieved with screws in combination with and screwing into mounting holes that are formed in advance in each frame of the window frame assembly 1.

Figure 8:
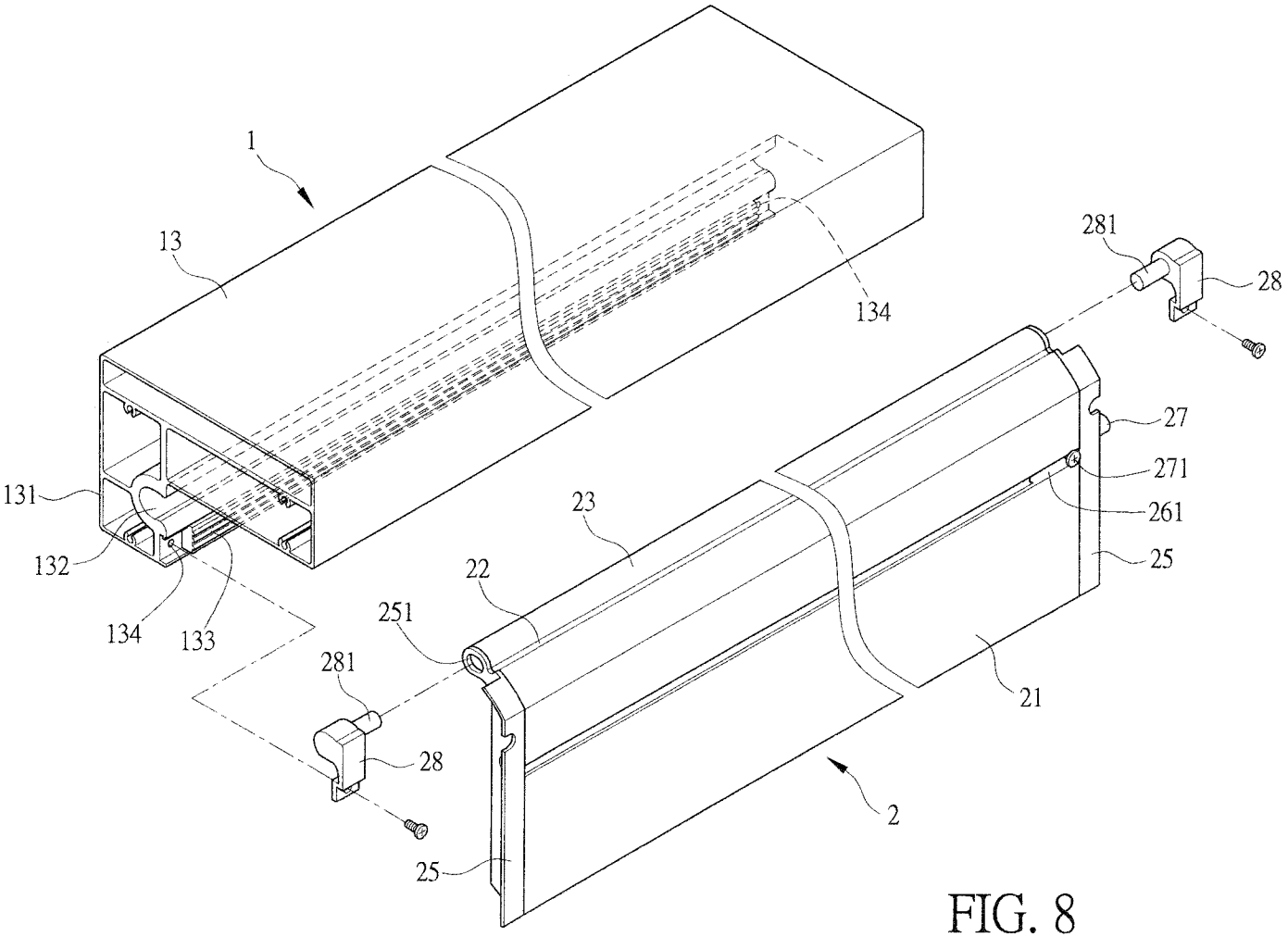
FIGS. 8 and 9 are schematic views showing the slat assembly and a top frame member according to the present invention in an assembled form.
Figure 9:
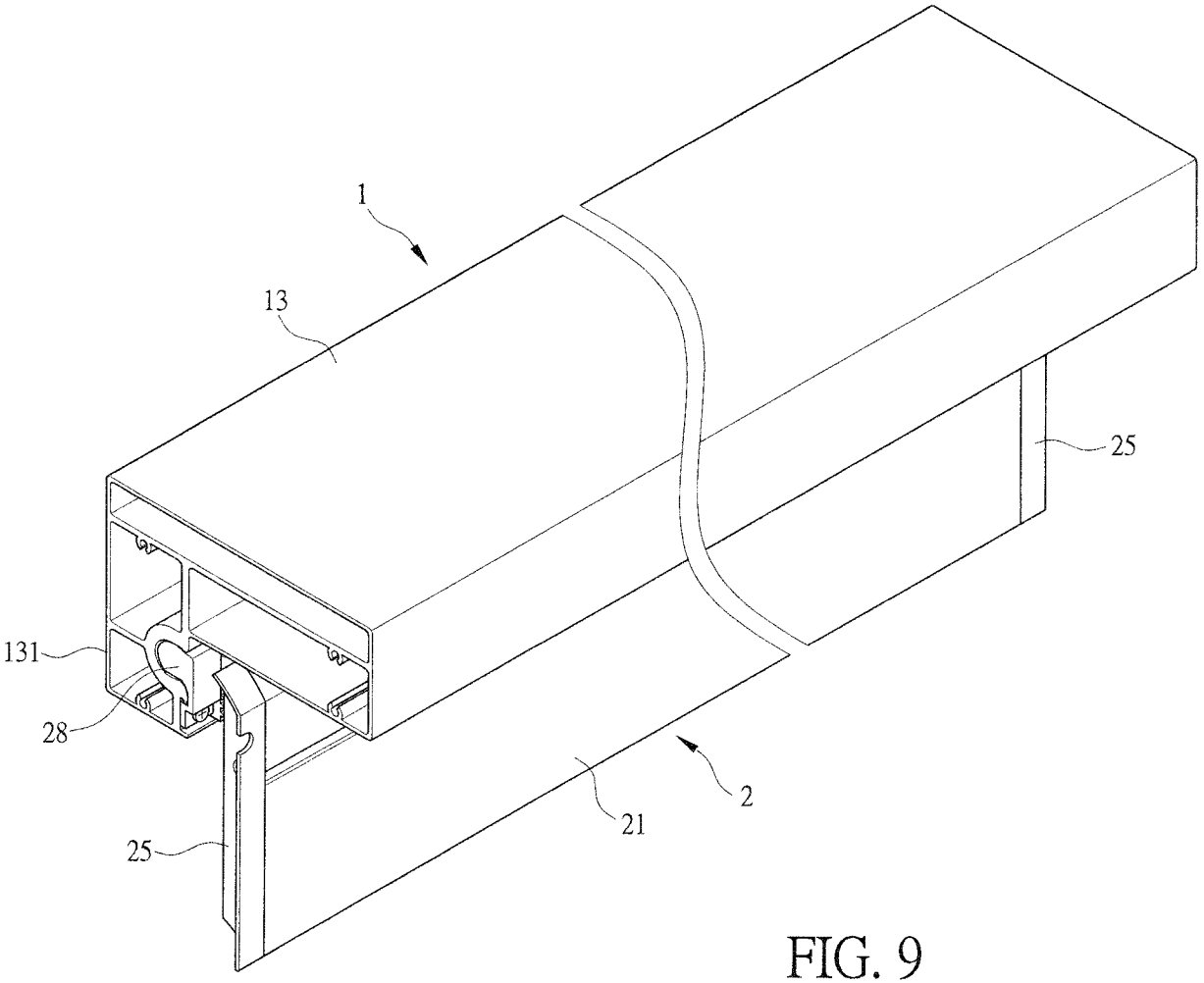

Further referring to FIGS. 8 and 9, next, assembling of each of the slat assemblies 2 is performed. Firstly, the pivot axle 23 of one of the slats 21 is set in alignment with the curved channel 132 of the top frame member 13, and the slat 21 is then pushed in a direction toward the top frame member 13 to have the pivot axle 23 of the slat 21 fit into and embedded in the curved channel 132 of the top frame member 13, and then, the axle 281 of the positioning piece 28 is set in alignment with and inserted into the hollow mounting ring 251 of the closure piece 25 of each of the two sides of the slat 21, and further extending into the elongate circular hole 24 of the pivot axle 23 of the slat 21, and then, a threaded fastening element is applied to fix the positioning piece 28 to the screw hole 134 at each of the two ends of the water-resisting strip 133 of the top frame member 13 to thereby complete assembling of the slat 21 to the top frame member 13.

Figure 10:
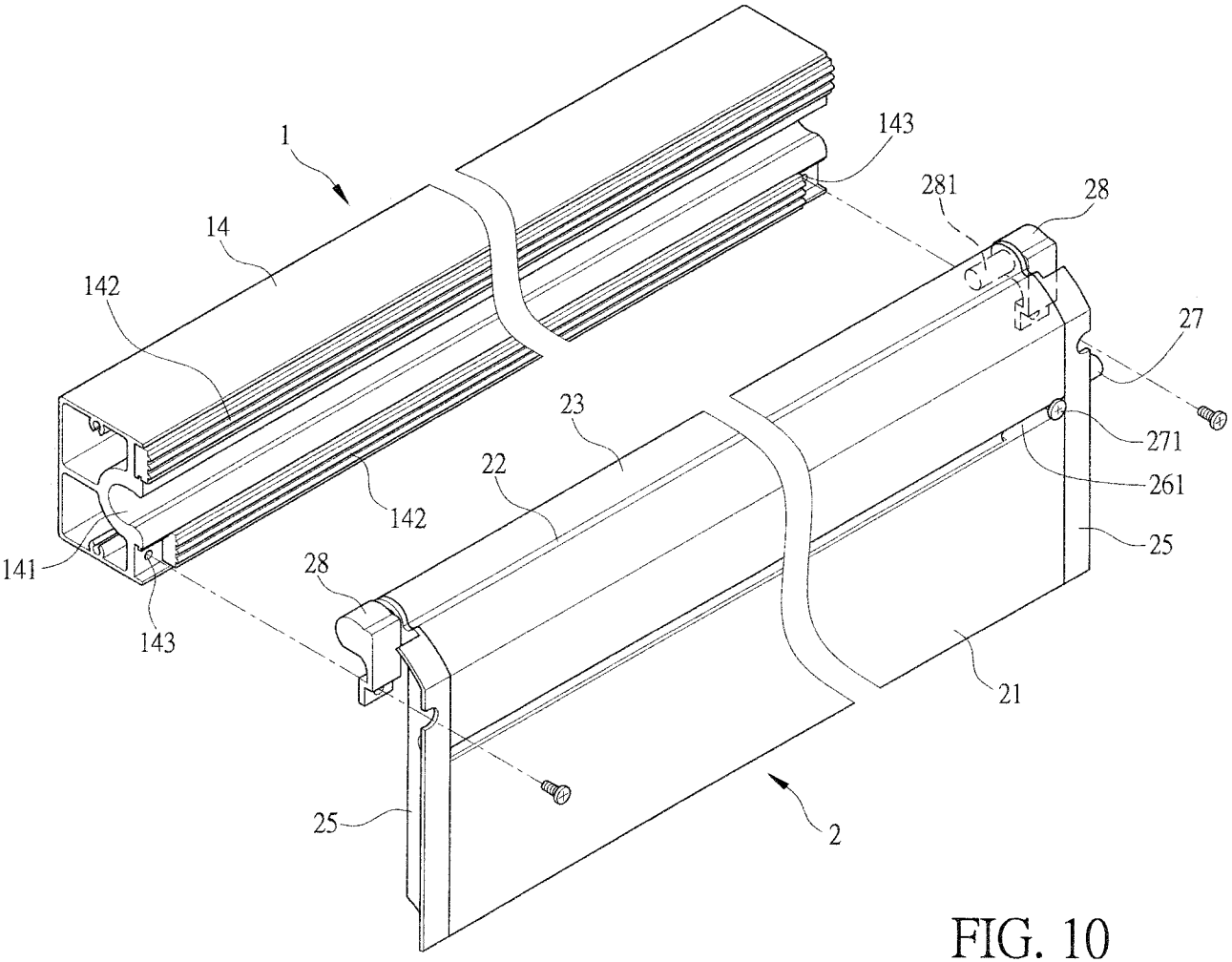
FIGS. 10 and 11 are schematic views showing the slat assembly and a positioning frame member according to the present invention in an assembled form.
Figure 11:
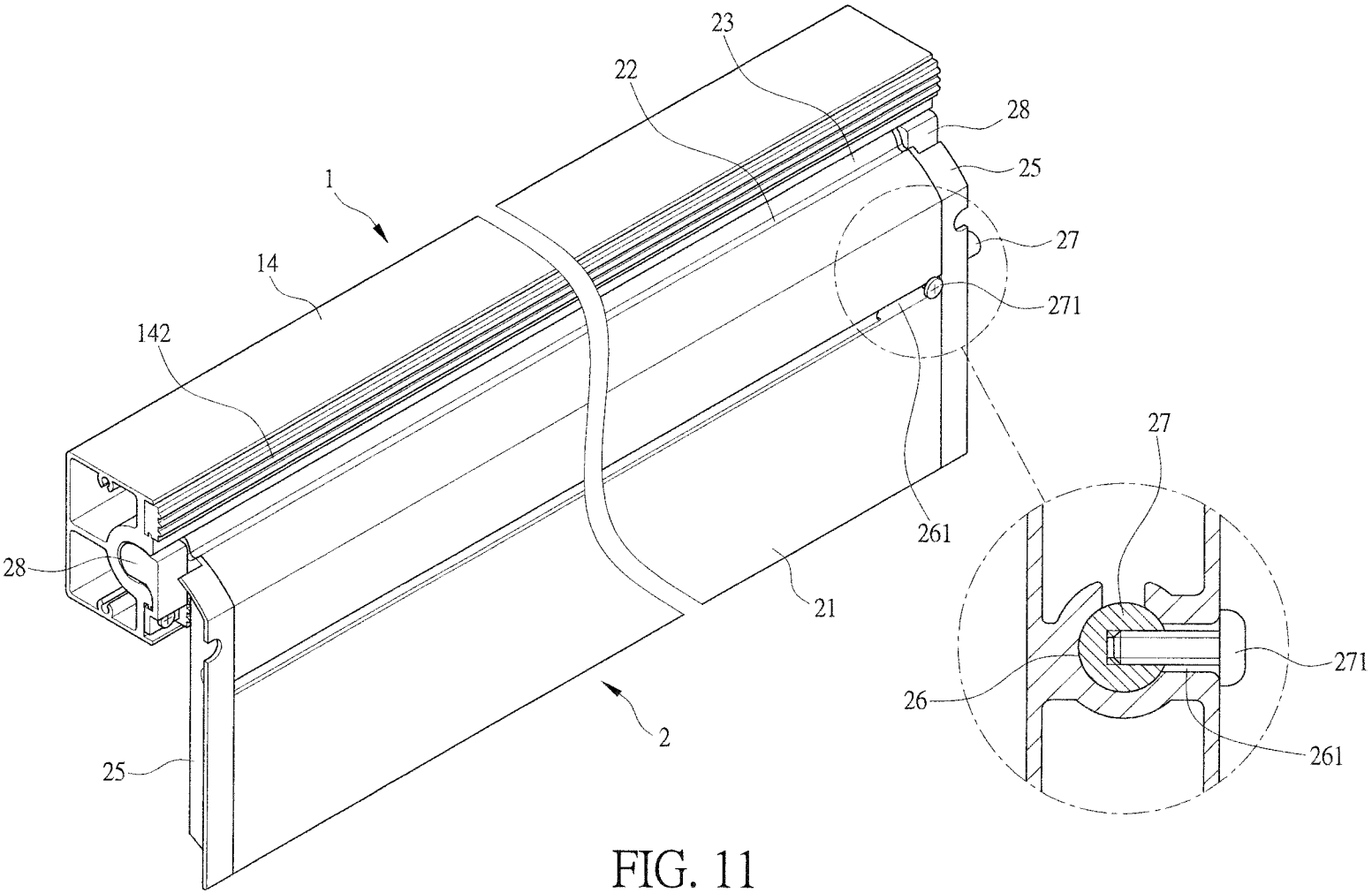
Figure 12:
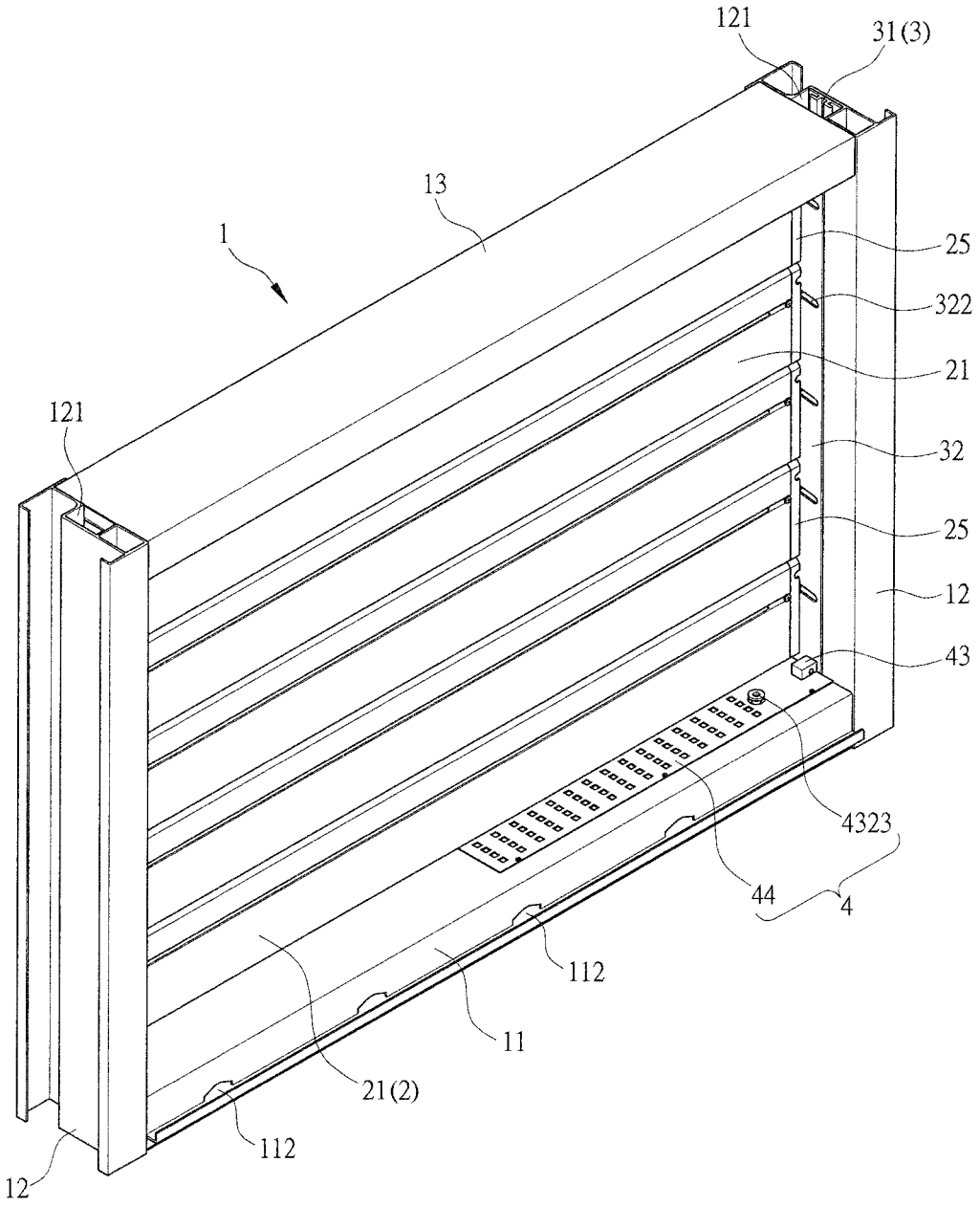
FIG. 12 is a view showing the present invention in an assembled form.
Figure 15:
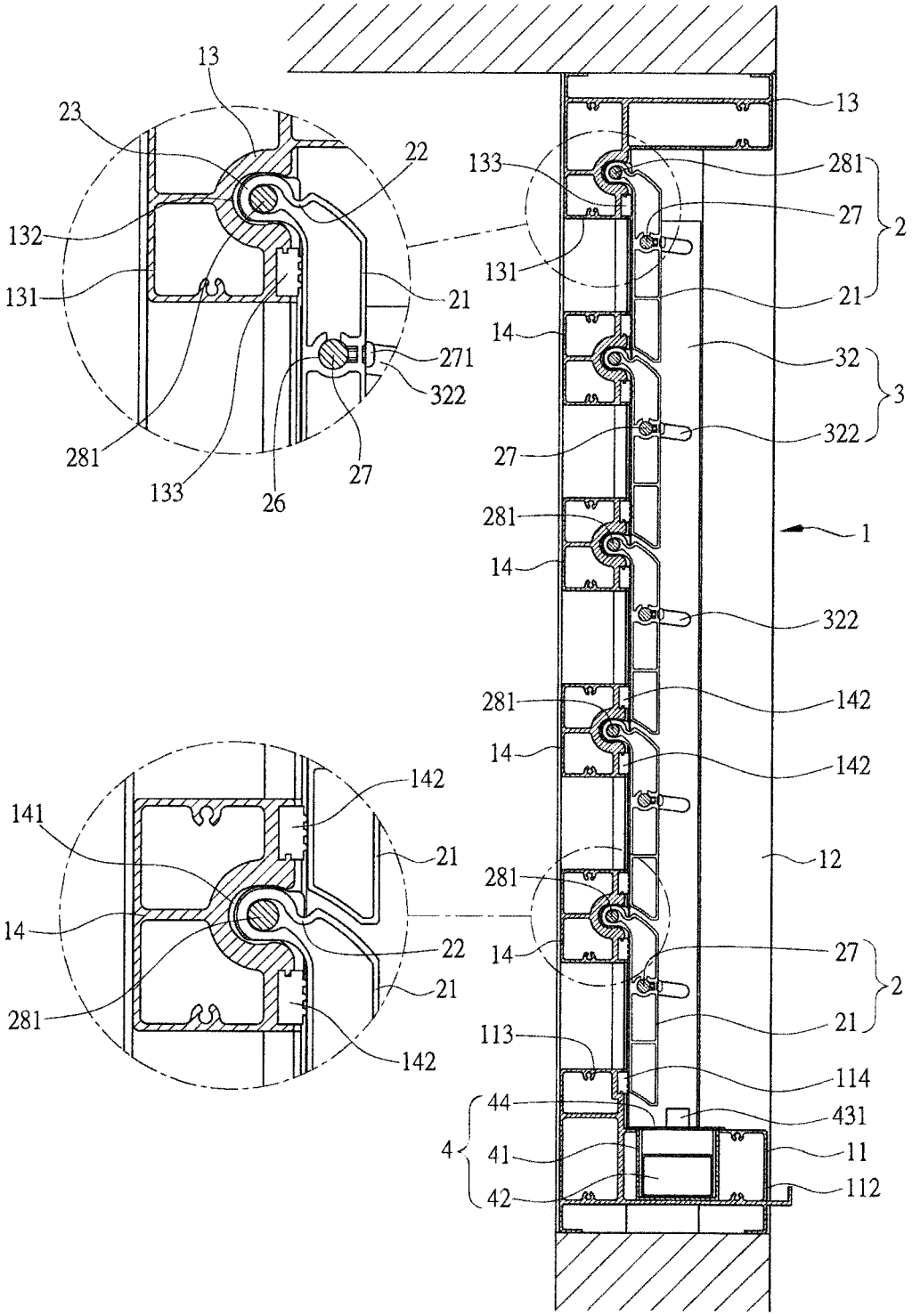
FIGS. 15 and 16 are schematic views showing the present invention in a closed condition.

Further referring to FIGS. 10, 11, and 15, the pivot axle 23 of each of the remaining slats 21 is set in alignment with the curved groove 141 of each of the positioning frame members 14 and the slat 21 is then pushed in a direction toward the positioning frame members 14, so that the pivot axle 23 of each of the slat 21 is fit into and embedded in the curved groove 141 of a corresponding one of the positioning frame members 14. Next, the axle 281 of each of the positioning pieces 28 is set in alignment with and inserted into the hollow mounting ring 251 of the closure piece 25 of each of the two sides of the slat 21, and further extending into the elongate circular hole 24 of the pivot axle 23 of the slat 21, and is fixed by a threaded fastening element screwed into the screw hole 134 at each of the two ends of the water-resisting strip 144 of the positioning frame member 14 to thereby complete assembling of the slat 21 to the positioning frame member 14. Next, one end of the constraint bar 27 is inserted into the horizontal groove 26 of the slat 21, and an opposite end is inserted into a corresponding one of the slot openings 322 of the moving piece 32, and the fixing element 271 is fastened and fixed to the elongate slot opening 261 of the slat 21. In this way, one by one, the two ends of the constraint bars 27 are respectively inserted into and fixed to the horizontal grooves 26 of the slats 21 and the slot openings 322 of the moving pieces 32 to complete the assembling of the present invention, as shown in FIG. 12.

Figure 13:
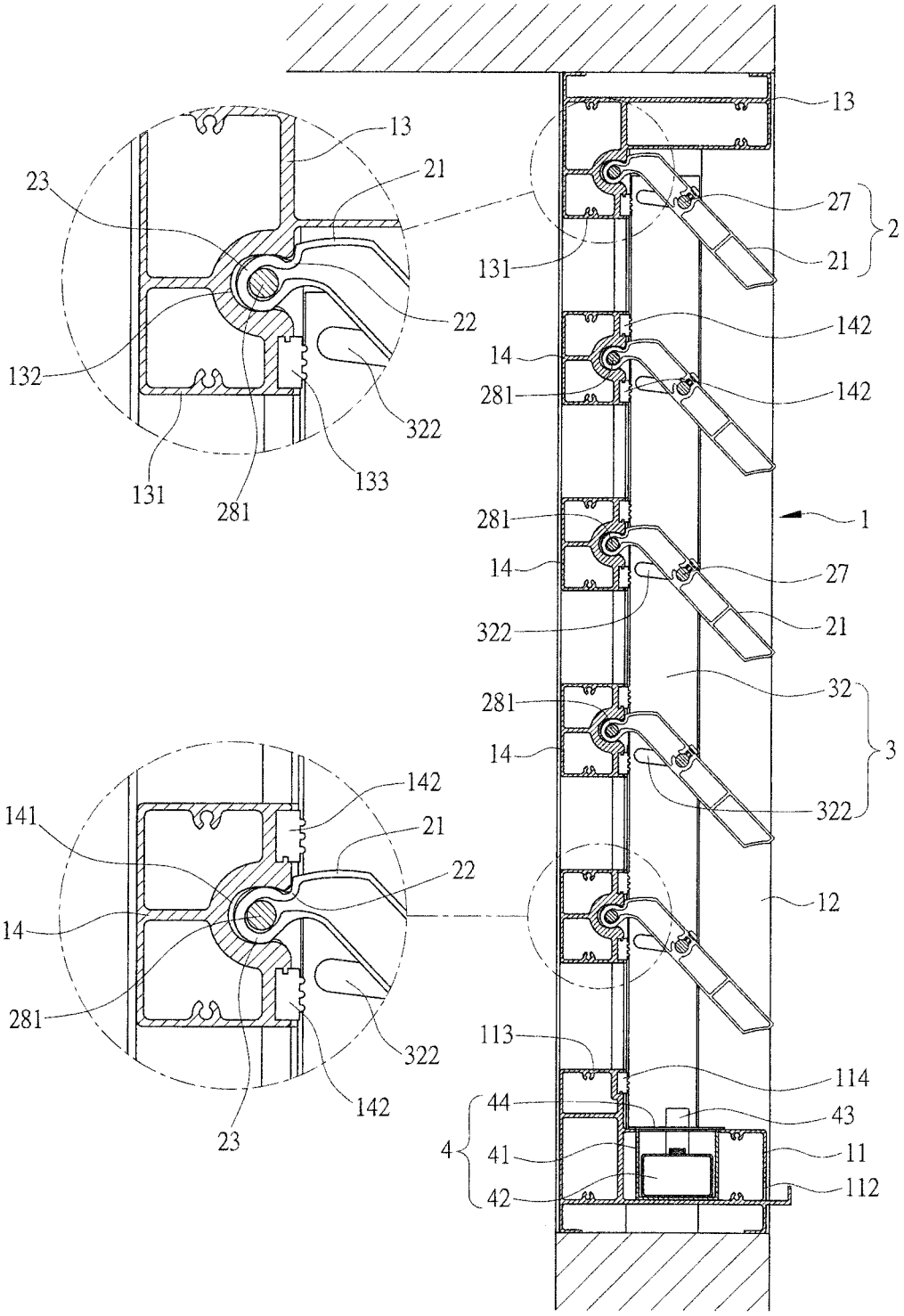
FIGS. 13 and 14 are schematic views showing the present invention in an open condition.
Figure 14:
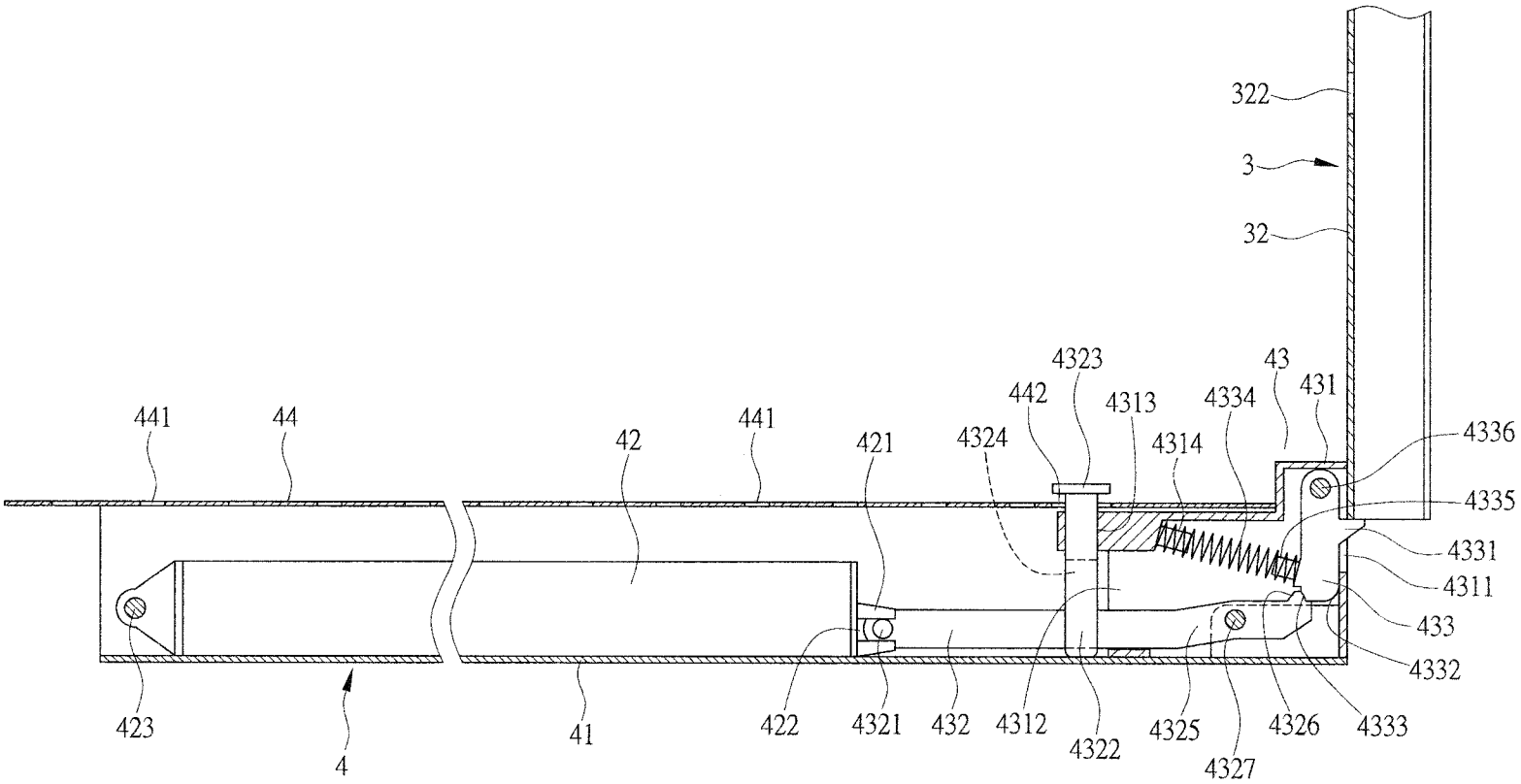

In the operation of the present invention, as shown in FIGS. 13 and 14, firstly, opening can be achieved by lifting any one of the slats 21 as being gripped and held by one hand. Under such a condition, due to the constraint bar 27 of all the slats 21 being inserted into the slot openings 322 of the moving pieces 32, all the slat 21 are driven to move simultaneously, and the constraint bar 27 of each of the slats 21 is moving, though sliding, in the corresponding one of the slot openings 322 of the moving piece 32, to thereby lift the moving piece 32 upward. Once a lower end of the moving piece 32 passes over the stage 4331 of the arresting piece 433 of the trigger seat 43, the stage 4331 losses engagement thereof as being retained by the moving piece 32, and the stage 4331 is biased by the spring force of the spring 4334 to project out of the shell base 431, and under such a condition, the lower circular arc like arc rounded corner 4332 of the arresting piece 433 is first sliding over the projecting block 4326 of the link bar 432 and then, the sloped corner 4333 of the arresting piece 433 is in retaining engagement with the slope edge of the outside surface of the projecting block 4326 of the link bar 432, wherein the lower circular arc like arc rounded corner 4332 of the arresting piece 433 is structured to allow for easy sliding by the projecting block 4326 of the link bar 432, so that the lower end of the moving piece 32 could be seated on the stage 4331 of the arresting piece 433. This would allow each of the slats 21 to be set in an open condition, achieving a purpose of enabling air flowing for ventilation.

Figure 16:
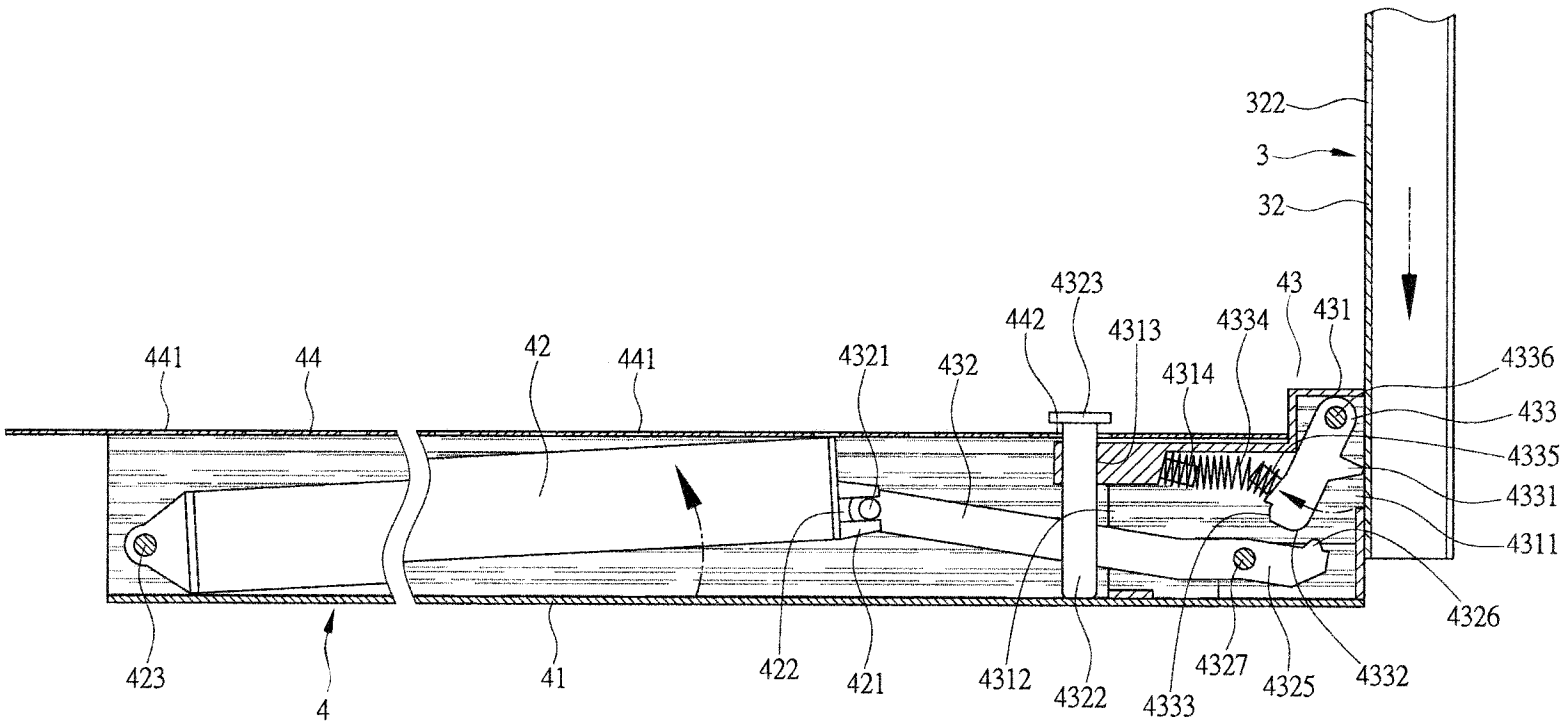

Further referring to FIGS. 15 and 16, in a flooding condition, external water flows through the plurality of through holes 112 formed in a side wall of the bottom frame member 11 and the hollowed portions 441 of the surface cover 44 to get into the bottom box 41 of the buoyance switch assembly 4. As the water level increasingly heightens, the float 42 becomes floating. However, due to one end of the float 42 is pivotally connected to the bottom box 41, the opposite end of the float 42 is gradually floating upward, so that the link bar 432 that is pivotally connected to the opposite end of the float 42 by means of the mounting base 421 is caused to bend downward in an opposite direction and the portion of the link bar 432 that includes the projecting block 4326 is inclined downward, with the pin 4327 serving as a supporting point or fulcrum. Consequently, the projecting block 4326 of the link bar 432 is released from the retaining engagement thereof with the sloped corner 4333 of the arresting piece 433. Once the arresting piece 433 is released from retaining engagement with the link bar 432, the moving piece 32 is released from being constrained and start sliding downward and the arresting piece 433 is caused to oscillate into the interior of the trigger seat 43 as being pushed by the moving piece 32. The downward movement of the moving piece 32 is conducted and guided by the mutual fitting between the sliding channel 321 thereof and the wing portions 312 of the connecting piece 31, so that the moving piece 32 is kept to move in a vertical direction. Due to the slot openings 322 of the moving piece 32 receiving the constraint bars 27 of the slats 21 to extend therein, when the moving piece 32 is released from the retaining engagement with the arresting piece 433, the slats 21 are also released from constraint and oscillate downward to achieve an automatic closing operation of the slats 21. When the slats 21 oscillate downward to show a closed condition, the bottommost one of the slats 21 would have a lower edge thereof abutting and in contact engagement with the water-resisting strip 114 of the raised portion 113 of the bottom frame member 11, while an upper edge is abutting and in contact engagement with the water-resisting strip 142 of the positioning frame member 14 to which it is pivotally connected. Each of the intermediate ones of the slats 21 has an upper edge abutting and in contact engagement with the water-resisting strip 142 at the one of the positioning frame members 14 that it is pivotally connected and a lower edge is abutting and in contact engagement with the water-resisting strip 142 of another one of positioning frame members 14 that is located therebelow. The topmost one of the slats 21 has an upper edge abutting and in contact engagement with the water-resisting strip 133 of the top frame member 13, and a lower edge is abutting and in contact engagement with the water-resisting strip 142 of another one of positioning frame members 14 that is located therebelow. Two ends of each of the slat 21 are both abutting and in contact engagement with the water-resisting strips 123 of the seats 122 of the two upright side frame members 12. Such an arrangement allows each of the slats 21 to provide a maximum effect of sealing, wherein when the slats 21 moves downward to close, the axles 281 of the positioning pieces 28 on two sides thereof are located on vertical lines that are different from the a vertical line on which the constraint bars 27 of the slats 21 are located, so that the downward moving and closing of the slats 21 would provide an inward pushing force, which in combination with the gravity of the slats 21, would ensure an initial stage of flooding protection. Further, the slot openings 322 of the moving piece 32, are set in an inclined condition, which helps force the constraint bars 27 of the slats 21 to slightly shift inward, causing the slats 21 to apply an increased, inward-orienting pushing force, so as to further enhance the initial stage flooding protection.

Following the above description, with the water level increasingly heightening, the external water of flooding brings an increased water pressure, making each of the slats 21 supporting and acted upon by an increased inwardly pushing force. Since the pivot axle 23 of the slat 21 has a cross section that is of a configuration of an elongate circular form, in combination with the partly open curved channel 132 of the top frame member 13 that is in an elliptic form and the partly open curved groove 141, which is in an elliptic form, at the side of the positioning frame members 14, when the slats 21 take an increased inward pushing force, the pivot axles 23 of the slats 21 would further, slightly, displace in a direction toward the interior of the partly open curved channel 132 of the top frame member 13 and the partly open curved channel 141 of the positioning frame members 14, and consequently, the slats 21 would achieve and provide even more tight engagement with the water-resisting strips 114, 123, 142, 133, providing each of the slats 21 with an improved effect of flooding protection that is sufficient to resist an increased water pressure.

When the flood recedes, the plurality of through holes 112 formed in the bottom frame member 11 may allow water to drain, so that the water entering the bottom frame member 11 may flow out of the through holes 112 to drain with the receding flood. After the draining is completed, the operation of moving and opening the slots 21 may be performed to exhibit an open condition to restore the function of air flowing and ventilation.

Figure 17:
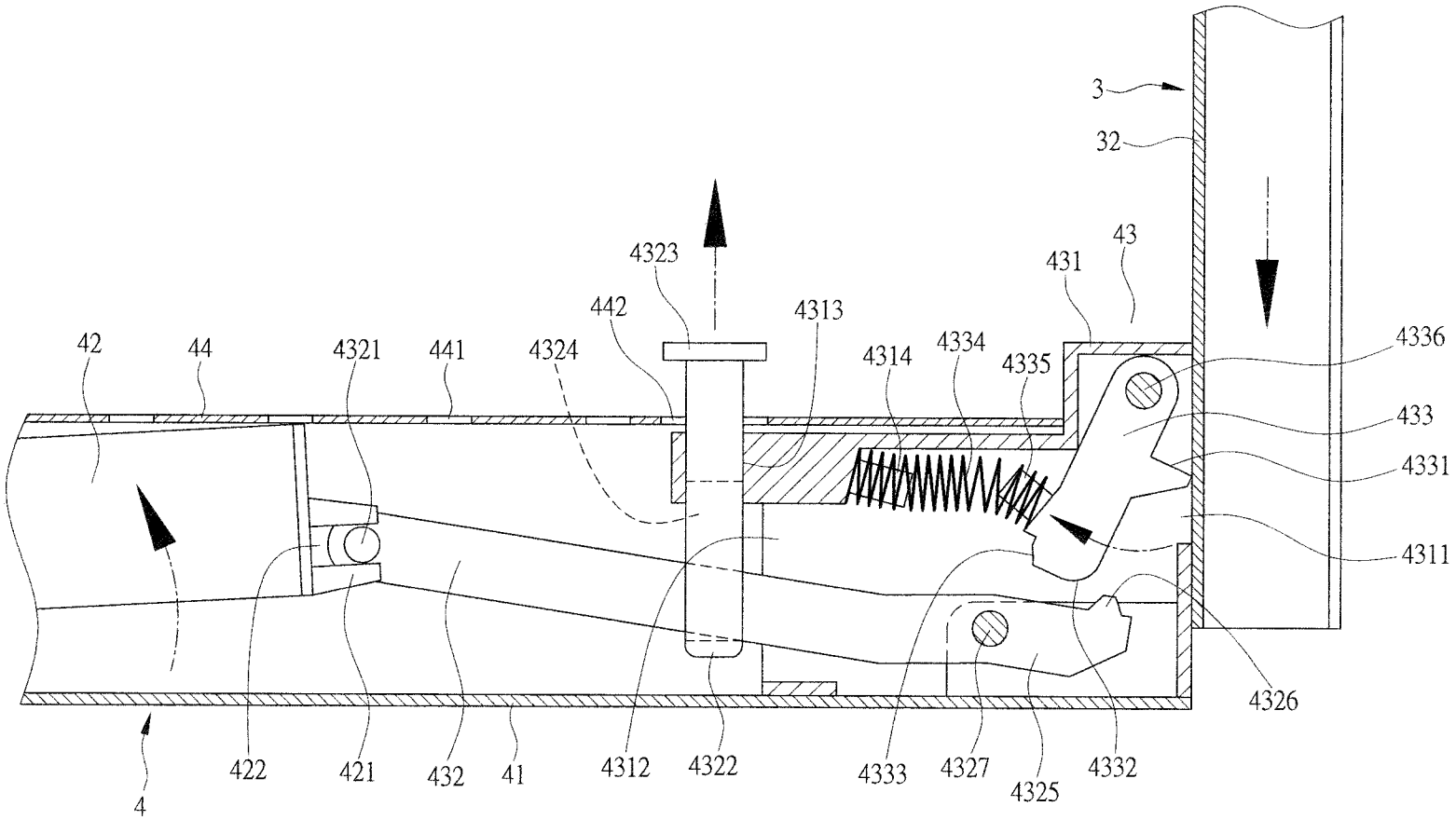
FIG. 17 is a schematic view showing closing the present invention with a hand operation.

Further referring to FIG. 17, besides the closing operation carried out during flooding for automatic closing to prevent water from flowing inward, it is also possible for the present invention to close or shut up if required, and in such a case, an operator may hand hold or use a tool for assistance to lift upward the peg 4322 of the trigger seat 43 through which the link bar 432 is fit, and the peg 4322, upon being lifted upward, drives the link bar 432 to move upward simultaneously. As such, as noted previously, the curved-up segment 4325 of the link bar 432 inclines downward by taking the pin 4327 as a fulcrum, so that the projecting block 4326 of the link bar 432 is released from the retaining engagement thereof with the sloped corner 4333 of the arresting piece 433, and the arresting piece 433 is caused, through being pushed by the downward movement of the moving piece 32, to oscillate in a direction toward the interior of the trigger seat 43. Due to the constraint bars 27 of the slats 21 being received in the slot openings of the moving piece 32, when the moving piece 32 is released from being retained by the arresting piece 433, the slats 21 are also released from constraint and oscillate downward so as to achieve an automatic closing operation for each of the slats 21, providing a way of closing by manual operation.

I claim:

1. A flood-protective ventilation louver, at least comprising:

a window frame assembly, which at least comprises a bottom frame member, two side frame members, a top frame member opposite to the bottom frame member, and a plurality of positioning frame members;

slat assemblies, which is combined with the window frame assembly, each of the slat assembly comprising a slat in the form of an elongate plate, the slat having an upper end that is extended to form a pivot axle;

a transmission mechanism, which comprises a connecting piece and a moving piece and is mounted to the window frame assembly to drive the slats of the slat assemblies to move; and a buoyance switch assembly, which comprises a bottom box, a float, a trigger seat, and a surface cover and functions to drive the transmission mechanism.

2. The flood-protective ventilation louver according to claim 1, wherein the bottom frame member comprises a body that defines a receptacle portion.

3. The flood-protective ventilation louver according to claim 1, wherein the bottom frame member has one side that is formed with a raised portion, the raised portion having a side wall on which a water-resisting strip is arranged alongside.

4. The flood-protective ventilation louver according to claim 1, wherein each of the two side frame members comprises recessed channel extending in a vertical direction.

5. The flood-protective ventilation louver according to claim 4, wherein a plurality of water-resisting strips are mounted outside the recessed channel.

6. The flood-protective ventilation louver according to claim 5, wherein the recessed channel is provided on one side thereof with a plurality of seats to receive the water-resisting strips to fix thereto.

7. The flood-protective ventilation louver according to claim 1, wherein the top frame member comprises a bottom protrusion portion mounted to one side thereof to correspond to the raised portion of the bottom frame member, the bottom protrusion portion comprising a curved channel, which is partly open, extending along an axial direction thereof.

8. The flood-protective ventilation louver according to claim 7, wherein the curved channel has a cross section that comprises a horizontal elliptic configuration.

9. The flood-protective ventilation louver according to claim 7, wherein the curved channel is provided, on a lower edge thereof, with a water-resisting strip.

10. The flood-protective ventilation louver according to claim 1, wherein each of the positioning frame members is provided, in one side thereof, with a curved groove, which is partly open, extending along an axial direction thereof.

11. The flood-protective ventilation louver according to claim 10, wherein the curved groove has a cross section that comprises a horizontal elliptic configuration.

12. The flood-protective ventilation louver according to claim 10, wherein the curved groove has upper and lower edges that are provided with water-resisting strips.

13. The flood-protective ventilation louver according to claim 1, wherein the pivot axle of the slat assemblies has an outer circumference of which a cross section is formed in a configuration of an elongate circular hole.

14. The flood-protective ventilation louver according to claim 1, wherein a neck is connected between the slat and the pivot axle of each of the slat assemblies and is slightly inclined and is tapering to gradually reduce a thickness thereof.

15. The flood-protective ventilation louver according to claim 1, wherein the pivot axle of each of the slat assemblies is formed, in an interior thereof, with an elongate circular hole.

16. The flood-protective ventilation louver according to claim 1, wherein the slat of each of the slat assemblies has a surface that is formed with a horizontal groove, and the horizontal groove has an interior into which a constraint bar is inserted.

17. The flood-protective ventilation louver according to claim 16, wherein the constraint bar is provided with a fixing element.

18. The flood-protective ventilation louver according to claim 1, wherein the slat of each of the slat assemblies has two sides each comprising a closure piece.

19. The flood-protective ventilation louver according to claim 18, wherein the closure piece comprises a hollow mounting ring.

20. The flood-protective ventilation louver according to claim 18, wherein the closure piece is provided, at an outer side thereof, with a positioning piece, and the positioning piece comprises an axle, the axle extending through the hollow mounting ring of the closure piece to penetrate into the elongate circular hole of the pivot axle.

21. The flood-protective ventilation louver according to claim 1, wherein the connecting piece of the transmission mechanism is formed as an elongate plate and comprises a flat plate portion and a pair of wing portions.

22. The flood-protective ventilation louver according to claim 1, wherein the moving piece of the transmission mechanism is formed as an elongate body and comprises a sliding channel into which the wing portions of the connecting piece are received to penetrate therethrough.

23. The flood-protective ventilation louver according to claim 1, wherein the moving piece the transmission mechanism further comprises a plurality of slot openings that are arranged at intervals.

24. The flood-protective ventilation louver according to claim 23, wherein the slot openings of the moving piece of the transmission mechanism are formed as elongate slots inclining relative to a horizontal direction.

25. The flood-protective ventilation louver according to claim 1, wherein the bottom box of the buoyance switch assembly has a top and two ends that are open to receive the bottom box to be disposed in the receptacle portion of the bottom frame member.

26. The flood-protective ventilation louver according to claim 1, wherein the float of the buoyance switch assembly has an end pivotally connected through a pin to the bottom box, and an opposite end of the float is provided with a mounting base.

27. The flood-protective ventilation louver according to claim 26, wherein the mounting base comprises a cruciform groove.

28. The flood-protective ventilation louver according to claim 1, wherein the trigger seat of the buoyance switch assembly comprises a shell base, a link bar, and an arresting piece, wherein the shell base two sides respectively comprising a first hollowed area and a second hollowed area that are open to the outside; the link bar has an end to which a cross bar is mounted to couple with the mounting base of the float, the link bar having an opposite end formed as a curved-up segment, the curved-up segment being provided, on an upper side thereof at a location adjacent to an end thereof, with a projecting block; the arresting piece is formed as an elongate block that has an upper portion that is mounted inside the shell base by a pin penetrating through two opposite lateral side surfaces thereof, the arresting piece being provided, on one end side thereof, with a stage, the arresting piece having a lower side of which one corner is formed as arc rounded corner as a circular arc and an opposite corner is formed as a sloped corner having an outside surface that is inclined, a spring being arranged on one end side of the arresting piece.

29. The flood-protective ventilation louver according to claim 28, wherein the shell base is formed with a through hole penetrating therethrough beside the second hollowed area.

30. The flood-protective ventilation louver according to claim 28, wherein the projecting block of the curved-up segment of the link bar is formed with a slope edge on at least one outside surface.

31. The flood-protective ventilation louver according to claim 28, wherein a peg is fit over outside of the link bar.

32. The flood-protective ventilation louver according to claim 31, wherein the peg has an upper end comprising a head part having a diameter larger than a diameter thereof.

33. The flood-protective ventilation louver according to claim 1, wherein the surface cover of the buoyance switch assembly comprises a plurality of hollowed portions extending through a body thereof, and the surface cover is set on and covers the receptacle portion of the bottom frame member and is fixed to the bottom frame member.

34. The flood-protective ventilation louver according to claim 1, wherein the surface cover of the buoyance switch assembly comprises an extending-through hole, the extending-through hole through which the head part of the peg that is fit to the link bar projects outside.

* * * * *